United States Patent [19]

Badesha et al.

[11] Patent Number: 4,520,010

[45] Date of Patent: May 28, 1985

[54] PROCESS FOR MODIFYING THE ELECTRICAL PROPERTIES OF SELENIUM, AND SELENIUM ALLOYS

[75] Inventors: Santokh S. Badesha, Ontario; Martin A. Abkowitz, Webster, both of N.Y.

[73] Assignee: Xerox Corporation, Stamford, Conn.

[21] Appl. No.: 500,504

[22] Filed: Jun. 2, 1983

[51] Int. Cl.[3] ..... B05D 7/14

[52] U.S. Cl. ..... 427/83; 427/74; 427/207.1; 75/121; 423/508; 423/510

[58] Field of Search ..... 75/97 R, 97 A, 101 R, 75/108, 121; 423/508, 509, 510; 560/246; 427/74, 83, 207.1

[56] References Cited

U.S. PATENT DOCUMENTS

| | | | |
|---|---|---|---|
| 2,474,966 | 7/1949 | Addink et al. | 252/62.3 |
| 2,860,954 | 11/1958 | Bueker et al. | 23/209 |
| 4,007,255 | 2/1977 | Buckley | 423/510 |
| 4,009,249 | 2/1977 | Buckley | 423/510 |

OTHER PUBLICATIONS

Zingaro, Ralph A. and Cooper, W. Charles, *Selenium* Van Nostrand Reinhold Co., 1974, pp. 109–113 and 805–806.

*Primary Examiner*—John Doll
*Assistant Examiner*—Robert L. Stoll
*Attorney, Agent, or Firm*—E. O. Palazzo

[57] ABSTRACT

Disclosed is a process for improving the electron transporting properties of selenium, or selenium alloys, by (1) providing a source of selenium, or selenium alloy, (2) treating the selenium, or selenium alloy with hydrazine contained in an organic solvent in an amount of from about 0.1 percent by volume to about 15 percent by volume, (3) heating the resulting mixture to a temperature of from about 50 degrees centigrade to about 120 degrees centigrade, wherein there results selenium or a selenium alloy have homogeneously and permanently absorbed thereon hydrazine.

8 Claims, No Drawings

PROCESS FOR MODIFYING THE ELECTRICAL PROPERTIES OF SELENIUM, AND SELENIUM ALLOYS

BACKGROUND OF THE INVENTION

This invention is generally directed to processes for modifying the electrical properties of certain substances, and more specifically, the present invention is directed to a process for the surface treatment of selenium and selenium alloys, for the primary purpose of improving the electron transporting properties of these substances. Thus in accordance with the process of the present invention, certain selected reducing agents, such as hydrozine, are caused to be homogeneously permanently absorbed, or chemisorbed on the surface of selenium, or selenium alloys for the purpose of extending the electron transporting range capabilities of these materials. Accordingly thus subsequent to treatment in accordance with the process of the present invention the electrical behavior of selenium, or selenium alloys is desirably modified.

The selection of selenium or selenium containing substances as xerographic imaging members is well known in the art. These members are generally subjected to a uniform electrostatic charge for the purpose of sensitizing the surface of the photoconductive layer, followed by exposure of an image to activating electromagnetic radiation, such as light, which selectively dissipates the charge in the illuminated areas, of the photoconductive insulating member, and wherein a latent electrostatic image is formed in the non-illuminated areas. The resulting image may then be developed and rendered visible by depositing thereon toner particles. In addition to single layer selenium imaging members, recently, there has been disclosed layered organic and inorganic photoresponsive devices containing amorphous selenium, trigonal selenium, amorphous selenium alloys, halogen doped selenium, halogen doped selenium alloys, phthalocyanines, and the like. One such photoresponsive member is comprised of a substrate, a photogenerating layer containing trigonal selenium, or vanadyl phthalocyanine dispersed in a resinous binder, and a transport layer containing a diamine dispersed in a resinous binder, reference, U.S. Pat. No. 4,265,990.

With regard to single layer photoresponsive devices containing amorphous selenium or amorphous selenium alloys, during the latent image formation step, light is absorbed in a thin region in close proximity to the positively charged top surface. The resulting photoinjected holes, or positive charges, which are then injected into the selenium substance for example, are primarily responsible for causing discharge. In multi-layered photoresponsive devices containing inorganic photogenerators and organic transport layers, light is absorbed in the photogenerator layer, and the resulting photogenerated holes are injected and move through a transport layer. Therefore, amorphous selenium, or its alloys, which are used in such photoresponsive devices are considered to have extended hole range capabilities.

With regard to photoresponsive devices consisting of selenium or selenium alloys, where the surface is negatively charged, the resulting photogenerated electrons which are injected into the selenium substance for example are primarily responsible for causing discharge. Selenium or selenium alloys, selected for use in such devices are thus required to possess extended electron range capabilities. Therefore, for electrophotography selenium or selenium alloys with either extended electron and/or extended hole range are desired.

Presently, processes for preparing selenium result in photoconductive materials wherein the electrical properties of selenium cannot be predicted, and/or modified. Thus, for example, there is disclosed in U.S. Pat. Nos. 4,007,255 and 4,009,249 the preparation of stable, red amorphous selenium containing thallium, and the preparation of red amorphous selenium. In U.S. Pat. No. 4,007,255 there is disclosed a process for preparing an amorphous red selenium material containing thallium, which involves precipitating selenious acid containing from about 10 parts per million to about 10,000 parts per million of thallium dioxide, with hydrazine, from a solution thereof in methanol or ethanol, containing not more than about 50 percent by weight of water, at a temperature between about −20° C. and the freezing point of the solution and maintaining the resulting precipitate at a temperature of about −15° C. to about −3° C. until the solution turns to a red color. The U.S. Pat. No. 4,009,249 contains a similar disclosure with the exception that thallium is not contained in the material being treated.

Moreover there is disclosed in copending application Ser. No. 404,259 a process for obtaining selenium and selenium alloys in high purity by forming the esters of the desired elements, followed by separating the esters, and subjecting the esters subsequent to purification by crystallization or distillation to a reduction reaction with for example hydrazine, or sulfur dioxide.

There continues to be a need for improved processes for preparing photoconductive substances such as selenium, and selenium alloys with extended electron range capabilities. Additionally, there continues to be a need for an improved simple economical process wherein selenium of modified electrical properties can be prepared. Additionally, there continues to be a need for improved processes wherein the electrical properties of commercially available selenium, or commercially available selenium alloys can be desirably modified.

OBJECTS OF THE INVENTION

It is an object of the present invention to provide improved processes for preparing selenium or selenium alloys of modified electrical properties.

In another object of the present invention there is provided improved processes for preparing selenium or selenium alloys with extended electron transporting range capabilities.

In still another object of the present invention there is provided processes for modifying the electrical properties of commercially available selenium which processes are simple, and economically attractive.

In yet another object of the present invention there are provided improved processes for obtaining selenium alloys with extended electron transporting properties by causing certain reducing agents, such as hydrazine to be homogeneously permanently absorbed on the surfaces of these substances.

These and other objects of the present invention are accomplished by providing a process for improving the electron transporting properties of selenium and selenium alloys which comprises (1) providing a source of selenium, or selenium alloy, (2) treating the selenium, or selenium alloy with hydrazine in an amount of 0.1 percent by volume, to about 15 percent by volume, at a temperature ranging from about 50 degrees centigrade to about 120 degrees centigrade, and (3) continuing the treatment for a period of time sufficient to cause the hydrazine to be homogeneously and permanently absorbed on the surface of the selenium, or selenium alloy. In accordance with the process of the present invention there results a selenium, or selenium alloy product wherein the electron transporting properties have been significantly increased, as compared to selenium alloys or selenium which have not been surface treated in accordance with the process described herein. Accordingly with the process of the present invention a selenium or selenium alloy product with extended electron transporting properties, or extended electron range capabilities is obtained.

The distance which electrons are transported in a photoresponsive device containing selenium, or selenium alloys for example, is critical with respect to these devices when they have been subjected to negative charges. In these devices the distance travelled by electrons in a given electrical field is a measure of the electron transporting properties of the material involved. This electron movement is usually terminated by deep trapping in the photoresponsive device. With photoconductive material possessing extended electron range capabilities there results for example a slower buildup of undesirable trapped negative charges during Xerographic cycling. An accumulation of trapped negative charges adversely affects the imaging properties of the device involved. For example a buildup of negative residual potential as a result of bulk deep trapping of electrons in the selenium or selenium alloy induces background in images obtained with such devices, thus causing xerographic images of low resolution to be produced. A measure of the electron transporting properties of devices containing selenium or selenium alloys, can be determined by for example negatively charging the device to a specific voltage and allowing the device to discharge, followed by determining the voltage remaining on the device subsequent to discharge. A device that is for example initially charged negatively to 200 volts, has poor electron transporting properties if subsequent to discharge the voltage measured thereon is 100 volts a decrease of 100 volts. In contrast a photoresponsive device of selenium, or selenium alloys when initially charged negatively to 200 volts, possesses extended electron range, that is the electrons in the device are transported to greater distances, when subsequent to discharge there is measured thereon a voltage for example of 10 volts.

In one embodiment the process of the present invention is accomplished by surface treating commercially available selenium, or selenium alloys, with a reducing agent such as hydrazine. This is accomplished by adding the selenium, or selenium alloy in an amount of from about 10 grams to about 1,000 grams, to a solution of hydrazine dissolved in an organic solvent such as cellosolve. This solution which contains from about 0.1 percent by volume to about 15 percent by volume of hydrazine is mixed while simultaneously being heated to a temperature of from about 50 degrees centigrade to about 120 degrees centigrade, and preferably from about 60 degrees centigrade to about 80 degrees centigrade. The reaction mixture is then allowed to cool, and the selenium or selenium alloy is separated therefrom by known filtration techniques, wherein there results on the surface of the material being treated hydrazine. This hydrazine is homogeneously and permanently absorbed on the surface of the selenium, or selenium alloy as evidenced for example by the significant increase in the electron transporting properties of the surface treated materials as compared to untreated materials.

The selenium, or selenium alloy to be treated is commercially available in powder or bead form, from for example Fischers Scienitific, Hoboken, Boliden (CCR ®). These substances generally have very poor electron transporting properties, that is when incorporated into a xerographic imaging device these materials do not substantially discharge after initial charging. Thus these commercially available materials when exposed to a flash light source will typically discharge to about 50 to 60 percent. In contrast when materials treated in accordance with the process of the present invention are subjected to the same exposure discharge approaches a desirable 100 percent. It is known that incomplete discharge results in images with high background.

In addition to hydrazine there can be selected as the surface treating material to be absorbed other aliphatic and aromatic amines such as pyridine, aniline, pyroline, pyridine alkylamines and the like. The treating material is present as a solution mixture with an organic solvent, such as cellosolve, ethanol, benzene, toluene, or dioxane and the like. Generally the surface active treating substance is present in the organic solvent in an amount ranging from about 0.1 percent by volume to about 15 percent by volume, and preferably in an amount of from about 1 percent by volume to about 10 percent by volume. The solution is vigorously stirred and shortly subsequent thereto there is slowly added an effective amount of the selenium, or selenium alloy, this addition occuring over a period of from about one minute to about five minutes. The resulting solution containing the selenium, or selenium alloy is then heated to a temperature of from about 50 degrees centigrade to about 120 degrees centigrade for a period from about 30 seconds to about five minutes. After cooling to room temperature the treated material is filtered from the solution by known filtration techniques including for example water suction or centrifugation. The resulting separated product can then be washed with an organic solvent such as cellosolve. The product is allowed to dry and there results a selenium, or selenium alloy having homogeneously absorbed on its surface the hydrazine.

Illustrative examples of selenium, or selenium alloys that can be surface treated in accordance with the process of the present invention for the purpose of improving the electron transporting properties of such materials include selenium-arsenic, selenium-tellurium, halogen doped selenium-arsenic, and halogen doped selenium-tellurium. The selenium-arsenic alloy contains from about 60% to about 99% by weight of selenium, and from about 1% to about 40 percent by weight of arsenic, while the selenium-tellurium alloy contains from about 55% by weight to about 99% by weight of selenium, and from about 45% by weight of tellurium to about 1% by weight of tellurium. Halogens such as chlorine can be incorporated into these alloys in amounts of from about 20 parts per million to about 800 parts per million.

Subsequent to treatment in accordance with the process of the present invention the selenium, or selenium alloy is deposited on a suitable substrate, such as aluminum, resulting in a photoresponsive device which can be incorporated into a xerographic imaging apparatus. The treated materials are usually deposited on the aluminum in a thickness of from about 20 to about 60 microns, with the thickness of the aluminum substrate varying from about 20 microns to about 3,000 microns. The resulting devices are particularly useful in xerographic imaging systems wherein the selenium, or selenium alloy photoconductor is charged negatively.

While it is not desired to be limited by theory it is believed that the hydrazine is simply absorbed on the surface of the selenium, or selenium alloy. Further it is believed that the hydrazine functions as a Lewis Base, causing holes or positive charges to be trapped, while at the same time permitting electrons to be transported in the selenium, or selenium alloy.

Additionally in accordance with the process of the present invention the electrical properties of selenium or selenium alloys obtained by subjecting the corresponding pure esters to a reduction reaction can be desirably controlled. Thus for example selenium or selenium alloys obtained by reacting a crude selenium, or selenium alloy substance with an alcohol thereby resulting in a ester which can be surface treated in accordance with the process of the present invention, once the ester has been isolated and subjected to a reduction reaction. Selenium or selenium alloys obtained by the reduction reaction described are 99.999% pure.

The details for obtaining selenium or selenium alloys of a purity of 99.999%, which materials can then be surface treated in accordance with the process of the present invention, are described in a copending application U.S. Ser. No. 404,259 the disclosure of which is totally incorporated herein by reference. As described in this application, there is provided an improved process for the preparation of selenium in a purity of 99.999 percent wherein selenious acid is reacted with an aliphatic alcohol, thereby resulting in the formation of a liquid dialkyl selenite ester, of the formula $(RO)_2SeO$, wherein R is an alkyl group as defined herein. This selenite ester subsequent to separation from the reaction mixture is further purified by distillation and then subjected to a reduction reaction wherein selenium of high purity, and in high yield is obtained. In a variation of this process the selenious acid, selenium oxides, and mixtures thereof are obtained by dissolving crude selenium, in strong acids such as nitric acid, sulfuric acid, and mixtures thereof.

The aliphatic alcohol selected for this process is generally of the formula ROH, wherein R is an alkyl group containing from 1 to about 30 carbon atoms, and preferably from 1 to about 6 carbon atoms. Illustrative examples of preferred R groupings for the aliphatic alcohol, and the selenite ester include methyl, ethyl, propyl, butyl, pentyl, and hexyl, with methyl and ethyl being preferred. Specific preferred alcohols selected for the process of the present invention include methanol, ethanol and propanol.

In another important variation of the above process there can be selected for formation of the ester a diol instead of an aliphatic alcohol. The diol selected is generally of the formula $HO(CR_1R_2)_nOH$ wherein $R_1$ and $R_2$ are hydrogen, or alkyl groups as defined herein, and n is a number ranging from 1 to about 10. Examples of preferred diols that may be selected include ethylene glycol, and propylene glycol.

The selenium esters resulting from the diol reaction are of the general formula

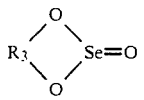

wherein $R_3$ is an alkylene group such as ethylene, methylene, propylene, and the like.

The pure, isolated dialkyl selenite ester can then be directly reduced to pure selenium by a reduction reaction, or as a optional step prior to reduction, the pure ester can be dissolved in water or an organic solvent, such as cellosolve, ethanol, and the like, resulting in a solution containing from about 25 percent to about 60 percent, and preferably from about 40 percent to about 50 percent, of the pure selenium ester.

The reduction reaction can be accomplished at various suitable temperatures, dependent on, for example, the reducing agent selected, and the solvent system used. Generally, the reduction reaction is accomplished at relatively low temperatures not exceeding about 100 degrees Centigrade. Specifically, the reduction reaction temperature can range from about 25 degrees Centigrade to about 100 degrees Centigrade, depending for example on the reducing agent being employed. Illustrative examples of reducing agents include those well known in the art such as hydrazine, sulfur dioxide, hydroxylamine, hydroquinones, thioureas, glyoxal, ascorbic acid, active methylene compounds, phosphites, and the like. The preferred reducing agents are hydrazine and sulfur dioxide.

The following examples further define certain embodiments of the present invention, it being noted that these examples are intended to be illustrative only and are not intended to limit the scope of the present invention. Parts and percentages are by weight unless otherwise indicated.

The testing performed on the devices prepared in accordance with the following examples for the purpose of determining the xerographic behavior thereof was accomplished at 294 degrees Kelvin. Discharge was effected by flash exposure for a sufficient time well in excess of that required to completely discharge the device. The important parameter measurement is the xerographic residual potential, that is the potential to which a well rested device containing a selenium, or selenium alloy is discharged by a single intrinsic flash exposure from a Xenon lamp. This residual potential provides a measure of the distance electrons travel prior to becoming immobilized.

Flash exposure was accomplished by subjecting the photoresponsive device to filtered light of 140 ergs/cm.$^2$ from a General Radio G.R. Strobtac, Xenon lamp, this exposure being well in excess of the amount of light needed to completely discharge the device.

The residual voltage measured and remaining on the photoresponsive devices of the following Examples subsequent to discharge is inversely proportional to the distance the photoinjected electron travels prior to being completely immobilized in a deep trap. Low negative residual potential, that is a voltage of less than about 10 volts, and preferably a voltage approaching one volt or less, corresponds to high Xerographic performance when latent image formation requires efficient electron transport in the photoreceptor, that is for example in those situations in which the photoresponsive device is negatively charged.

EXAMPLE I

There was prepared a photoreceptor device by vacuum evaporating commercially available selenium obtained from Fischers Scienitific on an aluminum substrate. The resulting device contained aluminum in a thickness of 60 microns, and selenium coated thereover in a thickness of 27 microns This device was then negatively charged in the dark, to 200 volts by transient contact to a power supply. Subsequently the device was then subjected to flash exposure with a Xenon lamp, 140 ergs/cm.$^2$ resulting in discharge of the device. The amount of voltage or residual potential remaining on the device subsequent to discharge was 80 volts as measured with an electrostatic probe.

EXAMPLE II

A photoresponsive device was prepared by adding 60 grams of amorphous selenium powder, commercially available from Fischers Scienitific to 500 milliliters of a solution containing 1% by volume of hydrazine in the organic solvent cellosolve. The resulting slurry was vigorously stirred and simultaneously heated at 120 degrees centigrade for two minutes. Subsequently the reaction mixture was allowed to cool to room temperature, and a black selenium precipitate was separated therefrom by filtration. The black selenium precipitate containing hydrazine absorbed on its surface was then washed several times to remove traces of hydrazine, and thereafter the product was dried under a vacuum for ten minutes.

A photoresponsive device was then prepared by depositing the above surface treated product on an aluminum substrate in accordance with the procedure of Example I. The selenium was present in a thickness of 25 microns on an aluminum substrate having a thickness of 60 microns.

The above device was then negatively charged in the dark to 200 volts by transient contact to a power supply. Subsequently the device was subjected to a flash exposure with a Xenon lamp, 140 ergs/cm$^2$ resulting in discharge. The amount of residual potential remaining on the device as measured with an electrostatic probe was less than 1 volt, indicating complete discharge as compared to incomplete discharge for the device of Example I.

EXAMPLE III

The procedure of Example II was repeated with the exception that 35 grams of selenium powder was mixed with 250 milliliters of a solution containing 1% by volume of hydrazine in the organic solvent cellosolve. A photoresponsive device was then prepared by vacuum evaporating the surface treated selenium onto an aluminum substrate the selenium being present in a thickness of 27 microns while the thickness of the aluminum substrate was 60 microns.

The device was then negatively charged to 200 volts and discharged in accordance with the procedure of Example II. Subsequent to discharge the residual voltage remaining on this device was less than one volt, as measured with an electrostatic probe indicating that the device had been completely discharged.

Other modifications of the present invention will occur to those skilled in the art based upon a reading of the present disclosure. These are intended to be included within the scope of this invention.

We claim:

1. A process for improving the electron transporting properties of selenium, consisting essentially of (1) providing a source of selenium, (2) treating the selenium, with hydrazine contained in an organic solvent in an amount of from about 0.1 percent by volume to about 15 percent by volume, (3) heating the resulting mixture to a temperature of from about 50 degrees centigrade to about 120 degrees centigrade, wherein there results selenium having homogeneously and permanently absorbed thereon water free hydrazine.

2. A process in accordance with claim 1 wherein the hydrazine is dispersed in the organic solvent cellosolve in an amount of from about 1% by volume to about 10% by volume.

3. A process in accordance with claim 1 wherein the solution is heated to a temperature of from about 80 degrees centigrade to about 100 degrees centigrade for a period of from about 30 seconds to about 5 minutes.

4. A process for improving the electron transporting properties of selenium alloys consisting essentially of (1) providing a selenium alloy, (2) treating the selenium alloy with hydrazine contained in an organic solvent in an amount of about 0.1 percent by volume to about 15 percent by volume, (3) heating the resulting mixture to a temperature of from about 50 degrees centigrade to about 120 degrees centigrade, wherein there results a selenium alloy having homogeneously and permanently absorbed thereon water free hydrazine.

5. A process in accordance with claim 4 wherein the selenium alloy is comprised of selenium and arsenic.

6. A process in accordance with claim 5 wherein the selenium arsenic alloy contains from about 80 percent by weight of selenium to about 99 percent by weight of selenium and from about 1 percent to weight of arsenic to about 20 percent by weight of arsenic.

7. A process in accordance with claim 4 wherein the selenium alloy is comprised of selenium and tellurium.

8. A process in accordance with claim 7 wherein the selenium tellurium alloy contains from about 60 percent by weight of selenium to about 99 percent by weight of selenium and from about 1 percent by weight of tellurium to about 40 percent by weight of tellurium.

* * * * *